US006405943B1

(12) United States Patent
Stadnyk

(10) Patent No.: US 6,405,943 B1
(45) Date of Patent: Jun. 18, 2002

(54) TOOL FOR REMOVING WATER FROM A WINDOW FRAME

(76) Inventor: John Stadnyk, 50 E. 66th St., New York, NY (US) 10021

( * ) Notice: Subject to any disclaimer, the term of this patent is extended or adjusted under 35 U.S.C. 154(b) by 0 days.

(21) Appl. No.: 09/780,152

(22) Filed: Feb. 9, 2001

(51) Int. Cl.[7] ..... B05B 7/32; A62C 13/62

(52) U.S. Cl. ..... 239/337; 239/309; 239/340; 239/271; 239/569; 222/5; 222/81; 222/83; 222/88

(58) Field of Search ..... 239/309, 337, 239/340, 271, 569; 222/5, 81, 88, 83, 83.5

(56) References Cited

U.S. PATENT DOCUMENTS

| | | | | |
|---|---|---|---|---|
| 765,022 | A | | 7/1904 | Loewenstein et al. |
| 2,016,113 | A | * | 10/1935 | Lambert et al. |
| 2,021,603 | A | * | 11/1935 | Kelley, Jr. et al. |
| 3,119,561 | A | * | 1/1964 | Wilson |
| 3,251,420 | A | * | 5/1966 | Rodgers |
| 3,472,292 | A | * | 10/1969 | Godfrey |
| 3,561,433 | A | | 2/1971 | Kovach |
| 3,776,227 | A | * | 12/1973 | Pitesky et al. |
| 4,190,034 | A | | 2/1980 | Wonisch |
| 4,446,990 | A | * | 5/1984 | Stevenson et al. |
| 4,489,855 | A | | 12/1984 | Boetger |
| D340,521 | S | | 10/1993 | Heinzelman et al. |
| 5,794,303 | A | | 8/1998 | Sanfilippo et al. |

* cited by examiner

*Primary Examiner*—Robin O. Evans

(57) ABSTRACT

A tool for removing water from a window frame for using forced air to remove water from behind a false window frame. The tool for removing water from a window frame includes a tubular member. The tubular member is elongate and has a first end and a second end. Each of the first. and second ends is open. An intermediate wall is positioned between the first and second ends. The intermediate wall has a plurality of holes extending therethrough. A spike is securely attached to the intermediate wall and has a pointed end extending towards the first end of the tubular member. A canister for holding a pressurized gas is positionable in. the cylinder such that the spike may puncture the canister. A valve is securely mounted in the tubular member and positioned between the intermediate wall and the second end of the tubular member. An actuating member actuates the valve such that gas from the canister may flow outward of the second end of the tubular member. A nozzle is removably positionable over the second end of the tubular member.

10 Claims, 4 Drawing Sheets

TOOL FOR REMOVING WATER FROM A WINDOW FRAME

BACKGROUND OF THE INVENTION

1 Field of the Invention

The present invention relates to forced-air directing tools and more particularly pertains to a new tool for removing water from a window frame for using forced air to remove water from behind a false window frame.

2 Description of the Prior Art

The use of forced-air directing tools is known in the prior art. More specifically, forced-air directing tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 765,022; U.S. Pat. No. 4,489,855; U.S. Pat. No. 3,561,433; U.S. Pat. No. 4,190,034; U.S. Pat. No. Des. 340,521; and U.S. Pat. No. 5,794,303.

While these devices fulfill their respective, particular objectives and requirements, the aforementioned patents do not disclose a new tool for removing water from a window frame. The inventive device includes a tubular member. The tubular member is elongate and has a first end and a second end. Each of the first and second ends is open. An intermediate wall is positioned between the first and second ends. The intermediate wall has a plurality of holes extending therethrough. A spike is securely attached to the intermediate wall and has a pointed end extending towards the first end of the tubular member. A canister for holding a pressurized gas is positionable in the cylinder such that the spike may puncture the canister. A valve is securely mounted in the tubular member and positioned between the intermediate wall and the second end of the tubular member. An actuating member actuates the valve such that gas from the canister may flow outward of the second end of the tubular member. A nozzle is removably positionable over the second end of the tubular member.

In these respects, the tool for removing water from a window frame according to the present invention substantially departs from the conventional concepts and designs of the prior art, and in so doing provides an apparatus primarily developed for the purpose of using forced air to remove water from behind a false window frame.

SUMMARY OF THE INVENTION

In view of the foregoing disadvantages inherent in the known types of forced-air directing tools now present in the prior art, the present invention provides a new tool for removing water from a window frame construction wherein the same can be; utilized for using forced air to remove water from behind a false window frame.

The general purpose of the present invention, which will be described subsequently in greater detail, is to provide a new tool for removing water from a window frame apparatus and method which has many of the advantages of the forced-air directing tools mentioned heretofore and many novel features that result in a new tool for removing water from a window frame which is not anticipated, rendered obvious, suggested, or even implied by any of the prior art forced-air directing tools, either alone or in any combination thereof.

To attain this, the present invention generally comprises a tubular member. The tubular member is elongate and has a first end and a second end. Each of the first and second ends is open. An intermediate wall is positioned between the first and second ends. The intermediate wall has a plurality of holes extending therethrough. A spike is securely attached to the intermediate wall and has a pointed end extending towards the first end of the tubular member. A canister for holding a pressurized gas is positionable in the cylinder such that the spike may puncture the canister. A valve is securely mounted in the tubular member and positioned between the intermediate wall and the second end of the tubular member. An actuating member actuates the valve such that gas from the canister may flow outward of the second end of the tubular member. A nozzle is removably positionable over the second end of the tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool for removing water from a window frame apparatus and method which has many of the advantages of the forced-air directing tools mentioned heretofore and many novel features that result in a new tool for removing water from a window frame which is not anticipated, rendered obvious, suggested, or even implied by any of the prior art forced-air directing tools, either alone or in any combination thereof.

It is another object of the present invention to provide a new tool for removing water from a window frame which may be easily and efficiently manufactured and marketed.

It is a further object of the present invention to provide a new tool for removing water from a window frame which is of a durable and reliable construction.

An even further object of the present invention is to provide a new tool for removing water from a window frame which is susceptible of a low cost of manufacture with regard to both materials and labor, and which accordingly is then susceptible of low prices of sale to the consuming public, thereby making such tool for removing water from a window frame economically available to the buying public.

Still yet another object of the present invention is to provide a new tool for removing water from a window frame which provides in the apparatuses and methods of the prior art some of the advantages thereof, while simultaneously overcoming some of the disadvantages normally associated therewith.

Still another object of the present invention is to provide a new tool for removing water from a window frame for using forced air to remove water from behind a false window frame.

Yet another object of the present invention is to provide a new tool for removing water from a window frame which includes a tubular member. The tubular member is elongate and has a first end and a second end. Each of the first and second ends is open. An intermediate wall is positioned between the first and second ends. The intermediate wall has a plurality of holes extending therethrough. A spike is securely attached to the intermediate wall and has a pointed end extending towards the first end of the tubular member. A canister for holding a pressurized gas is positionable in the cylinder such that the spike may puncture the canister. A valve is securely mounted in the tubular member and positioned between the intermediate wall and the second end of the tubular member. An actuating member actuates the valve such that gas from the canister may flow outward of the second end of the tubular member. A nozzle is removably positionable over the second end of the tubular member.

Still yet another object of the present invention is to provide a new tool for removing water from a window frame that is conveniently hand held for using on all windows.

Even still another object of the present invention is to provide a new tool for removing water from a window frame that has a nozzle for directing air in a small area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
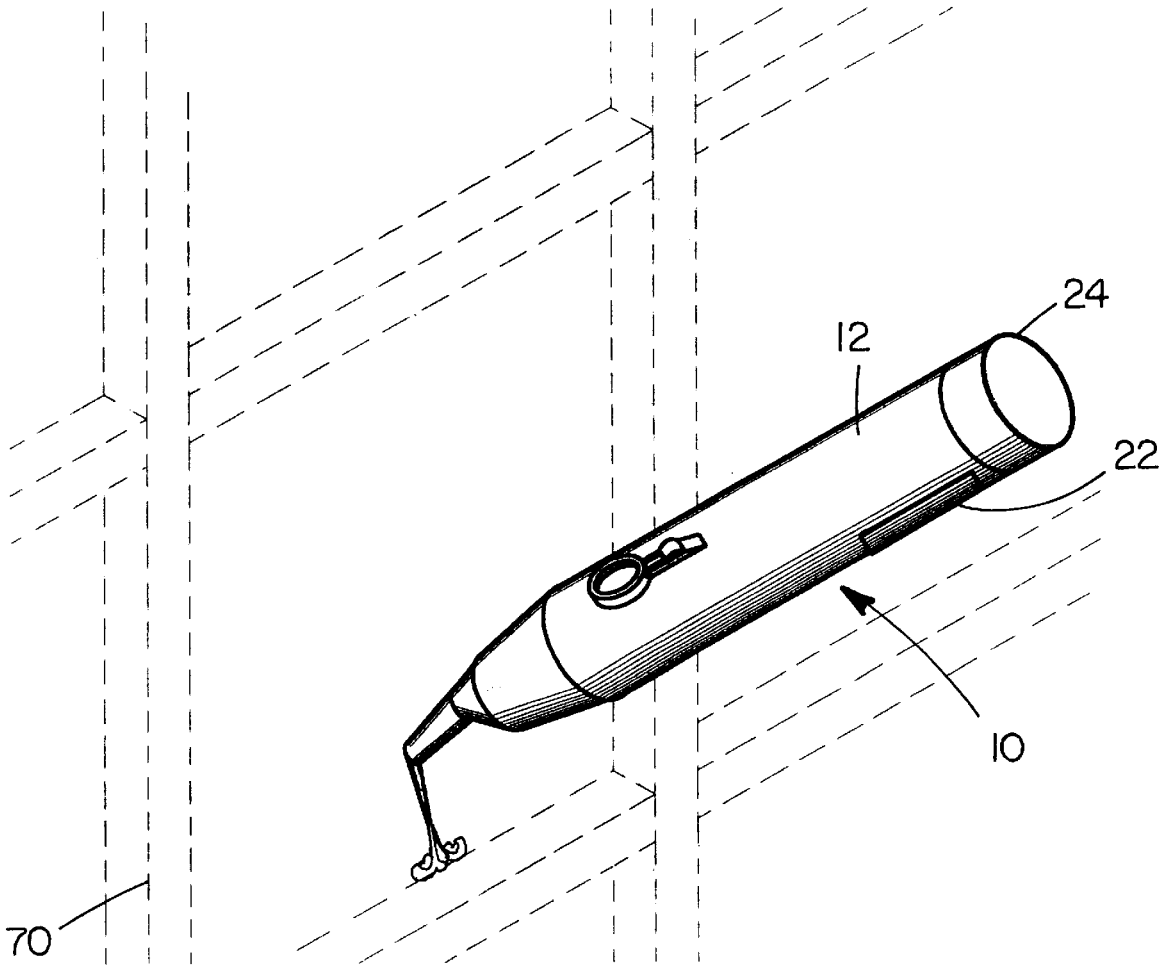
FIG. 1 is a schematic perspective view of a new tool for removing water from a window frame according to the present invention.
Figure 2:
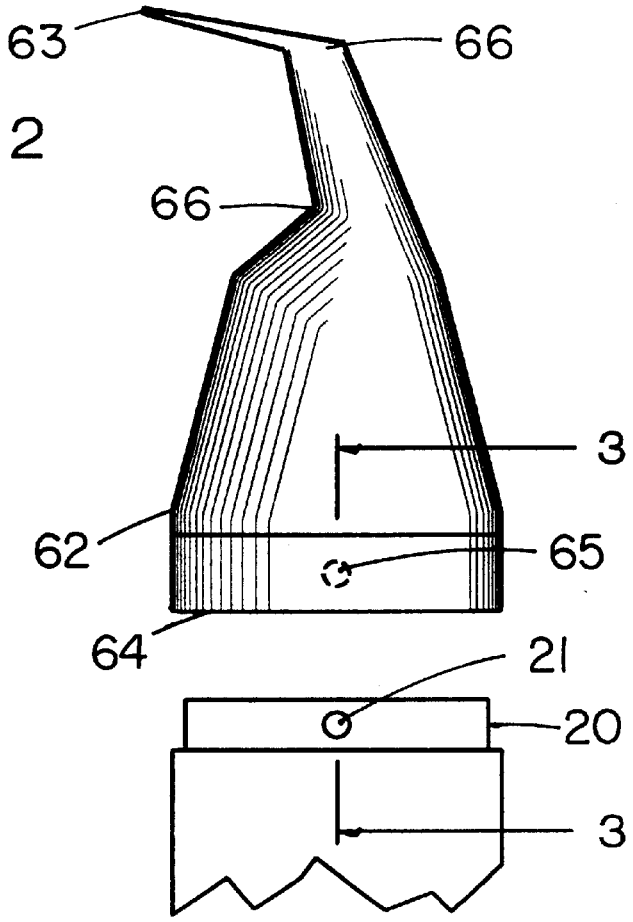
FIG. 2 is a schematic side view of the present invention.
Figure 3:
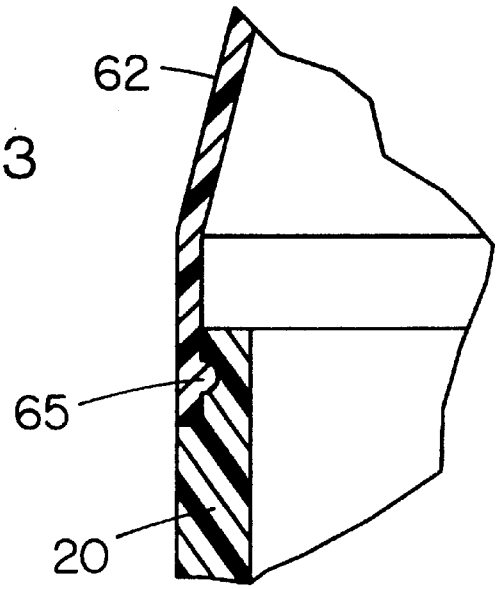
FIG. 3 is a schematic cross-sectional view taken along line 3—3 of the present invention.
Figure 4:
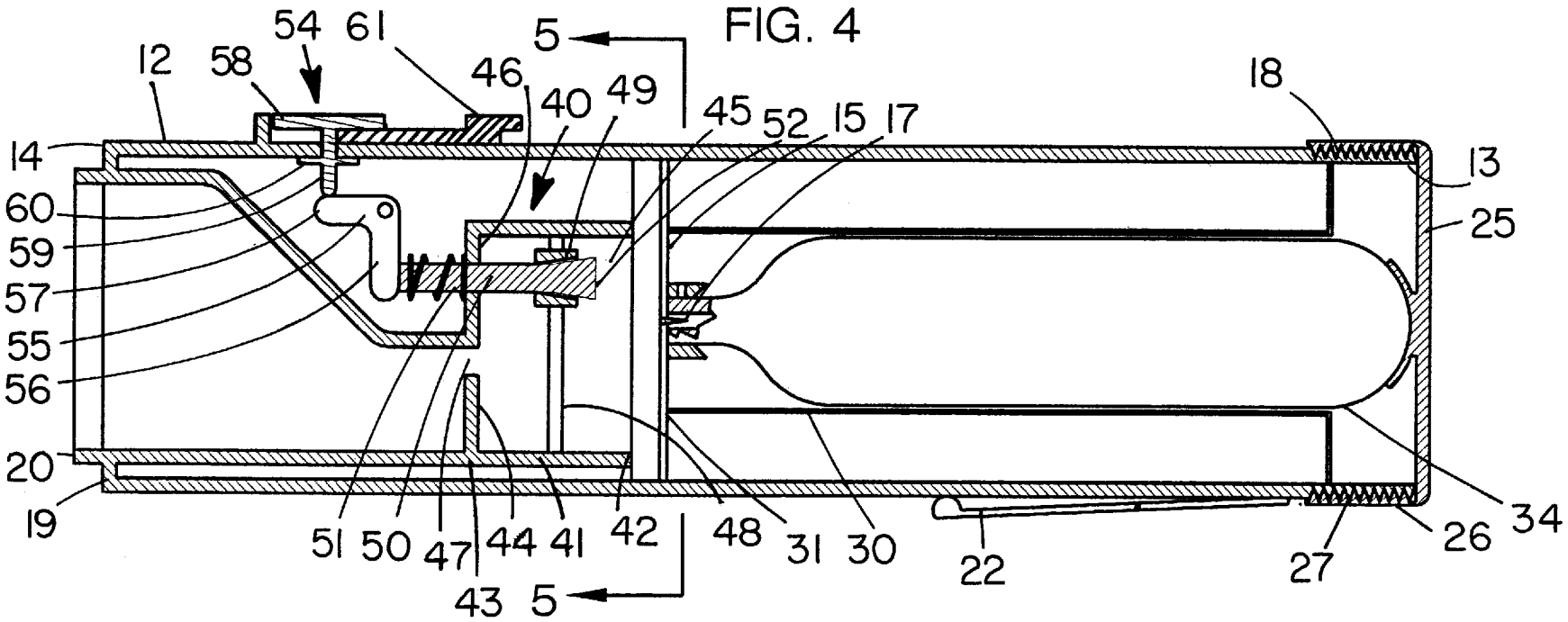
FIG. 4 is a schematic side cross-sectional view of the present invention.
Figure 5:
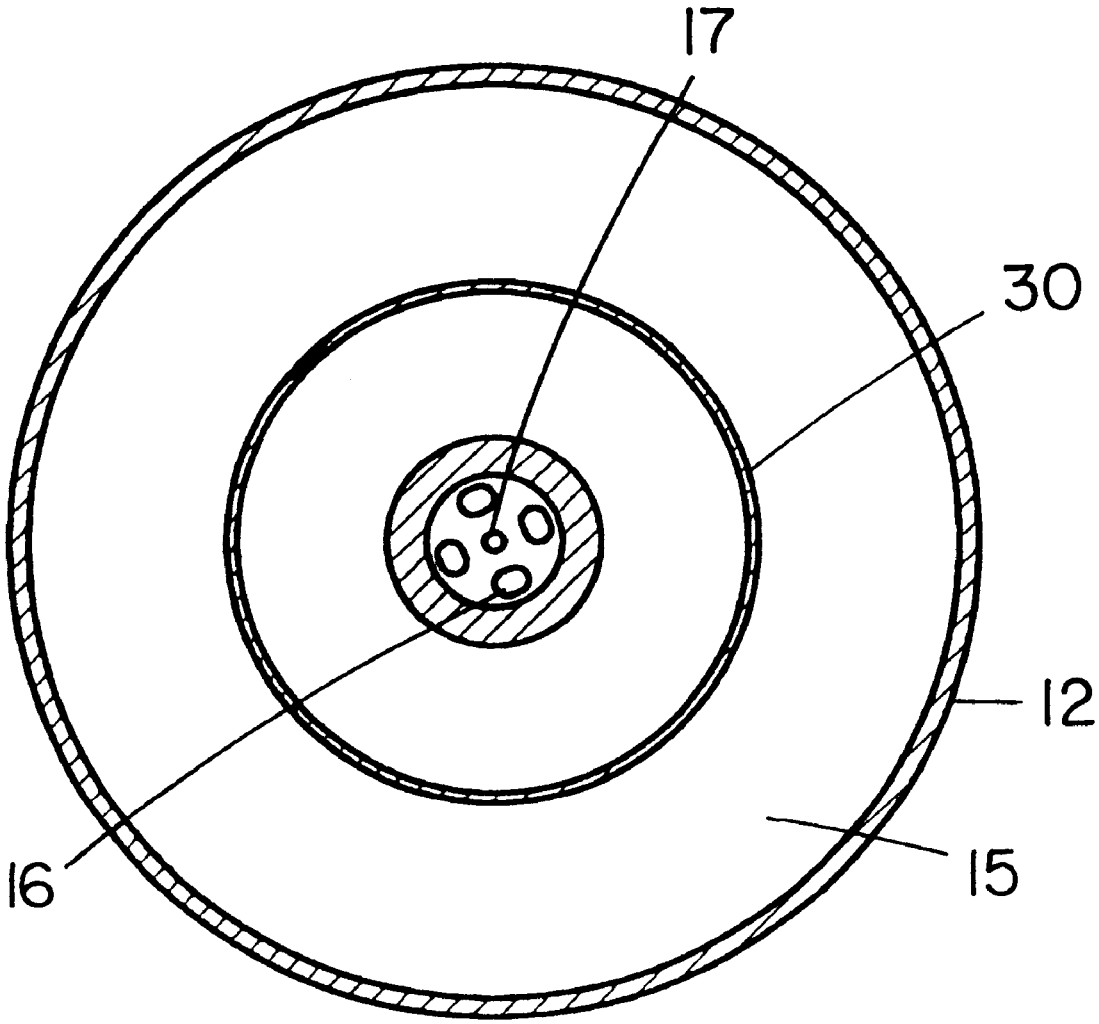
FIG. 5 is a schematic cross-sectional view taken along line 5—5 of the present invention.

With reference now to the drawings, and in particular to FIGS. 1 through 5 thereof, a new tool for removing water from a window frame embodying the principles and concepts of the present invention and generally designated by the reference numeral 10 will be described.

As best illustrated in FIGS. 1 through 5, the tool for removing water from a window frame 10 generally comprises a tubular member 12. The tubular member 12 is elongate and has a first end 13 and a second end 14. Each of,the first 13 and second 14 ends is open. An intermediate wall 15 is positioned between the first 13 and second 14 ends. The intermediate wall 15 has a plurality of holes 16 extending therethrough. The holes 16 are positioned in a central portion of the intermediate wall 15. A spike 17 is securely attached to the intermediate wall 15 and positioned and in the central portion of the intermediate wall 15. The spike 17 has a pointed end extending towards the first end 13 of the tubular member 12. The tubular member 12 has an outer surface 18. The outer surface positioned by the first end 13 is threaded. A peripheral shoulder 19 is integrally coupled to and extends inward of the second end 14 of the tubular member 12. An annular lip 20 is integrally coupled to the shoulder 19 and extends outwardly away from the tubular member 12. The annular lip 20 has an outer surface having a notch 21 therein. Preferably, a clip 22 is coupled to the tubular member 12 for removably attaching the device to the clothing of user.

A cover member 24 comprises a wall 25 having a peripheral lip 26 integrally coupled to the wall 25 and extending away therefrom. The peripheral lip 26 has an inner threaded surface 27. The lip 26 may threadably engage the tubular member 12.

A cylinder 30 is positioned in the tubular member. The cylinder 30 has a first end 31 securely attached to the intermediate wall 15 such that the cylinder 30 extends toward the first end 13 of the tubular member 12. The cylinder 30 has a pair of open ends and is substantially hollow.

A canister 34 holds a pressurized gas. The pressurized gas is preferably carbon dioxide. The canister 34 is positionable in the cylinder such that the spike 17 may-puncture the canister 34. The canister 34 is a conventional $C0_2$ canister.

A valve 40 is securely mounted in the tubular member 12 and positioned between the intermediate wall 15 and the second end 14 of the tubular member 12. The valve 40 includes a peripheral wall 41. The peripheral wall 41 has a first edge 42 securely coupled to the intermediate wall 15 such that the peripheral wall 41 extends toward the second end 14 of the tubular member 12.

A first wall 44 is securely coupled to a second edge 43 of the peripheral wall 41 such that the first wall 44 encloses a cavity 45 bounded by the intermediate wall 15, the peripheral wall 41 and the first wall 44. The first wall 44 has a first aperture 46 and a second aperture 47 extending therethrough.

A second wall 48 is securely coupled to an inner surface of the peripheral wall 41 and is positioned between the intermediate wall 15 and the first wall 44. The second wall 48 has an opening 49 therein. The opening 49 is generally coaxial with the first aperture 46 in the first wall 44.

A rod 50 is elongate and has a first portion 51 and a second portion 52. The first portion 51 has a generally cylindrical shape.

The second portion 52 has a generally frusto-conical shape such that the diameter of the second portion 52 increases as the second portion extends away from the first portion 51. The rod 50 extends through the opening 49 in the second wall and the first aperture 46 such that the second portion 52 of the rod 50 is positioned between the intermediate wall 15 and the second wall 48. The second portion 52 substantially seals the opening 49 in the second wall 48.

An actuating member 54 actuates the valve 40 such that carbon dioxide from the canister 34 may flow outward of the second end 14 of the tubular member 12. The actuating member 54 includes a lever 55. The lever 55 has an arm portion 57 and a leg portion 56. The lever 55 is pivotally positioned in the tubular member such that the leg portion 56 may selectively engage the rod 50 and the arm portion 57 extends toward the second end 14 of the tubular member 12.

A button includes a disk 58. An elongate member 59 is integrally coupled to and extends away from a bottom side of the disk 58. The elongate member 59 movably extends through a peripheral wall of the tubular member 12 and abuts the arm portion 57 of the lever 56. The elongate member 59 extends through an annular portion 60 and is securely coupled thereto such that the peripheral wall of the tubular member 12 is positioned between the disk 58 and the annular portion 60. Preferably, a switch 61 may slidably be positioned under the disk 58 to prevent the device 10 from accidentally discharging.

A nozzle 62 has a generally frusto-conical shape. The nozzle 62 has a first end 63 and a second end 64. The second end 64 of the nozzle 62 has a diameter greater than a diameter of the first end 63. An inner surface of the nozzle 62 has a nub 65 thereon. The nub 65 is positioned generally adjacent to the second end 64 of the nozzle 62. The second end 64 of the nozzle may be positioned over the annular lip 20 such that the notch 21 may fictionally engage the nub 65. The nozzle 62 has a pair of bends 66 therein such that the first end 63 of the nozzle 62 is directed at an angle with respect to a longitudinal axis of the tubular member 12 when the nozzle 62 is positioned on the tubular member 12.

In use, the canister 34 is positioned in the cylinder 30. The cover member 24 is placed on the device 10 and as it is closed it forces the spike 17 into the canister 34 so that the canister releases gas. The actuating member 54 actuates the valve 40 to release the gas through the nozzle 66. The gas is used to remove water behind a false window frame 70 to remove water collecting there. This prevents the water from eventually dripping down and staining the wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for removing water from a false window frame, said tool comprising:

a tubular member, said tubular member being elongate and having a first end and a second end, each of said first and second ends being open, an intermediate wall being positioned between said first and second ends, said intermediate wall having a plurality of holes extending therethrough, a spike being securely attached to said intermediate wall and having a pointed end extending towards said first end of said tubular member;

a canister for holding a pressurized gas, said canister being positionable in a cylinder such that said spike may puncture said canister;

a valve, said valve being securely mounted in said tubular member and positioned between said intermediate wall and said second end of said tubular member;

an actuating member for actuating said valve such that gas from said canister may flow outward of said second end of said tubular member;

a nozzle, said nozzle being removably positionable over said second end of said tubular;

said tubular member having an outer surface, said outer surface positioned by said first end being threaded a cover member, said cover member comprising a wall having a peripheral lip being integrally coupled to said wall and extending away therefrom, said lip having an inner threaded surface, wherein said lip may threadably engage said tubular member;

a cylinder being positioned in said tubular member, said cylinder having a first end securely attached to said intermediate wall such that said cylinder extends toward said first end of said tubular member, said cylinder having a pair of open ends and being substantially hollow, said spike extending into said cylinder; and said canister being positionable in said cylinder.

2. The tool for removing water from a false window frame as in claim 1, further comprising:

a peripheral shoulder being integrally coupled to and extending inward of said second end of said tubular member, an annular lip being integrally coupled to said shoulder and extending outwardly away from said tubular member, said annular lip having an outer surface having a notch extending therein;

said nozzle having a generally frusto-conical shape, said nozzle-having a first end and a second end, said first end of said nozzle having a diameter greater than a diameter of said second end, an inner surface of said nozzle having a nub thereon, said nub being positioned generally adjacent to said second end of said nozzle, wherein said second end of said nozzle may be positioned over said annular lip such that said notch may fictionally engage said nub.

3. The tool for removing water from a false window frame as in claim 2, wherein said nozzle further comprises said nozzle having a pair of bends therein such that said first end of said nozzle is directed at an angle with respect to a longitudinal axis of said tubular member when said nozzle is positioned on said tubular member.

4. A tool for removing water from a false window frame, said tool comprising:

a tubular member, said tubular member being elongate and having a first end and a second end, each of said first and second ends being open, an intermediate wall being positioned between said first and second ends, said intermediate wall having a plurality of holes extending therethrough, a spike being securely attached to said intermediate wall and having a pointed end extending towards said first end of said tubular member;

a canister for holding a pressurized gas, said canister being positionable in a cylinder such that said spike may puncture said canister;

a valve, said valve being securely mounted in said tubular member and positioned between said intermediate wall and said second end of said tubular member;

an actuating member for actuating said valve such that gas from said canister may flow outward of said second end of said tubular member;

a nozzle, said nozzle being removably positionable over said second end of said tubular;

a peripheral wall, said peripheral wall having a first edge securely coupled to said intermediate wall such that said peripheral wall extends toward said second end of said tubular member;

a first wall, said first wall being securely coupled to said second edge of said peripheral wall such that said first wall encloses a cavity bounded by said intermediate wall, said peripheral wall and said first wall, said first wall having a first aperture and a second aperture extending therethrough;

a second wall, said second wall being securely coupled to an inner surface of said peripheral wall and being positioned between said intermediate wall and said first wall, said second wall having an opening therein, said opening being generally coaxial with said first aperture in said first wall;

a rod, said rod being elongate and having a first portion and a second portion, said first portion having a generally cylindrical shape, said second portion having a generally frusto-conical shape such that the diameter of said second portion increases as said second portion extends away from said first portion, said rod extending through said opening in said second wall and said first aperture such that said second portion of said rod is positioned between said intermediate wall and said second wall, wherein said second portion substantially seals said opening in said second wall; and wherein said actuating means may engage said rod.

5. The tool for removing water from a false window frame as in claim 4, wherein said actuating means comprises:

a lever, said lever having an arm portion and a leg portion, said lever being pivotally positioned in said tubular member such that said leg portion may selectively engage said rod and said arm portion extends toward said second end of said tubular member; and a button, said button including a disk, an elongate member being integrally coupled to and extending away from a bottom side of said disk, said elongate member movably extending through a peripheral wall of said tubular member and abutting said arm portion of said lever, said elongate member extending through an annular portion and being securely coupled thereto such that said peripheral wall of the tubular member is positioned between said disk and said annular portion.

6. The tool for removing water from a false window frame as in claim 5, further comprising:

a peripheral shoulder being integrally coupled to and extending inward of said second end of said tubular member, an annular lip being integrally coupled to said shoulder and extending outwardly away from said tubular member, said annular lip having an outer surface having a notch extending therein;

said nozzle having a generally frusto-conical shape, said nozzle having a first end and a second end, said first end of said nozzle having a diameter greater than a diameter of said second end, an inner surface of said nozzle having a nub thereon, said nub being positioned generally adjacent to said second end of said nozzle, wherein said second end of said nozzle may be positioned over said annular lip such that said notch may fictionally engage said nub.

7. The tool for removing water from a false window frame as in claim 6, wherein said nozzle further comprises:

said nozzle having a pair of bends therein such that said first end of said nozzle is directed at an angle with respect to a longitudinal axis of said tubular member when said nozzle is positioned on said tubular member.

8. The tool for removing water from a false window frame as in claim 4, further comprising:

a peripheral shoulder being integrally coupled to and extending inward of said second end of said tubular member, an annular lip being integrally coupled to said shoulder and extending outwardly away from said tubular member, said annular lip having an outer surface having a notch extending therein;

said nozzle having a generally frusto-conical shape, said nozzle having a first end and a second end, said first end of said nozzle having a diameter greater than a diameter of said second end, an inner surface of said nozzle having a nub thereon, said nub being positioned generally adjacent to said second end of said nozzle, wherein said second end of said nozzle may be positioned over said annular lip such that said notch may fictionally engage said nub.

9. The tool for removing water from a false window frame as in claim 8, wherein said nozzle further comprises:

said nozzle having a pair of bends therein such that said first end of said nozzle is directed at an angle with respect to a longitudinal axis of said tubular member when said nozzle is positioned on said tubular member.

10. A tool for removing water from a false window frame, said tool comprising:

a tubular member, said tubular member being elongate and having a first end and a second end, each of said first and second ends being open, an intermediate wall being positioned between said first and second ends, said intermediate wall having a plurality of holes extending therethrough, said holes being positioned in a central portion of said intermediate wall, a spike being securely attached to said intermediate wall and positioned and in said central portion of said intermediate wall, said spike having a pointed end extending towards said first end of said tubular member, said tubular member having an outer surface, said outer surface positioned by said first end being threaded, a peripheral shoulder being integrally coupled to and extending inward of said second end of said tubular member, an annular lip being integrally coupled to said shoulder and extending outwardly away from said tubular member, said annular lip having an outer surface having a notch extending therein;

a cover member, said the cover member comprising a wall having a peripheral lip being integrally coupled to said wall and extending away therefrom, said lip having an inner threaded surface, wherein said lip may threadably engage said tubular member;

a cylinder being positioned in said tubular member, said cylinder having a first end securely attached to said intermediate wall such that said cylinder extends toward said first end of said tubular member, said cylinder having a pair of open ends and being substantially hollow;

a canister for holding a pressurized gas, said pressurized gas being carbon dioxide, said canister being positionable in said cylinder such that said spike may puncture said canister;

a valve, said valve being securely mounted in said tubular member and positioned between said intermediate wall and said second end of said tubular member, said valve comprising;

a peripheral wall, said peripheral wall having a first edge securely coupled to said intermediate wall such that said peripheral wall extends toward said second end of said tubular member;

a first wall, said first wall being securely coupled to said second edge of said peripheral wall such that said first wall encloses a cavity bounded by said intermediate wall, said peripheral wall and said first wall, said first wall having a first aperture and a second aperture extending therethrough;

a second wall, said second wall being securely coupled to an inner surface of said peripheral wall and being positioned between said intermediate wall and said first wall, said second wall having an opening therein, said opening being generally coaxial with said first aperture in said first wall;

a rod, said rod being elongate and having a first portion and a second portion, said first portion having a generally cylindrical shape, said second portion having a generally frusto-conical shape such that the diameter of said second portion increases as said second portion extends away from said first portion, said rod extending through said opening in said second wall and said first aperture such that said second portion of said rod is positioned between said intermediate wall and said second wall, wherein said second portion substantially seals said opening in said second wall;

an actuating member for actuating said valve such that carbon dioxide from said canister may flow outward of said second end of said tubular member, said actuating member comprising;

a lever, said lever having an arm portion and a leg portion, said lever being pivotally positioned in said tubular member such that said leg portion may selectively engage said rod and said arm portion extends toward said second end of said tubular member;

a button, said button including a disk, an elongate member being integrally coupled to and extending away from a bottom side of said disk, said elongate member movably extending through a peripheral wall of said tubular member and abutting said arm portion of said lever, said elongate member extending through an annular portion and being securely coupled thereto such that said the peripheral wall of the tubular member is positioned between said disk and said annular portion;

a nozzle, said nozzle having a generally frusto-conical shape, said nozzle having a first end and a second end, said first end of said nozzle having a diameter greater than a diameter of said second end, an inner surface of said nozzle having a nub thereon, said nub being positioned generally adjacent to said second end of said nozzle, wherein said second end of said nozzle may be positioned over said annular lip such that said notch may fictionally engage said nub, said nozzle having a pair of bends therein such that said first end of said nozzle is directed at an angle with respect to a longitudinal axis of said tubular member when said nozzle is positioned on said tubular member.

* * * * *